US012279711B2

(12) United States Patent
Tan

(10) Patent No.: US 12,279,711 B2
(45) Date of Patent: Apr. 22, 2025

(54) EXTERNALLY-MOUNTED HOLING-FREE MOUNTING MECHANISM FOR CURTAIN

(71) Applicant: NINGBO LIYANG NEW MATERIAL COMPANY LIMITED, Zhejiang (CN)

(72) Inventor: Baoguo Tan, Zhejiang (CN)

(73) Assignee: Ningbo Liyang New Material Company Limited, Zhejiang (CN)

( * ) Notice: Subject to any disclaimer, the term of this patent is extended or adjusted under 35 U.S.C. 154(b) by 46 days.

(21) Appl. No.: 18/219,182

(22) Filed: Jul. 7, 2023

(65) Prior Publication Data

US 2024/0008670 A1 Jan. 11, 2024

(30) Foreign Application Priority Data

Jul. 10, 2022 (CN) ..... 202221795002.0

(51) Int. Cl.

*A47H 1/122* (2006.01)
*A47H 1/02* (2006.01)
*A47H 1/00* (2006.01)

(52) U.S. Cl.

CPC ..... *A47H 1/122* (2013.01); *A47H 1/02* (2013.01); *A47H 2001/003* (2013.01)

(58) Field of Classification Search

CPC . E06B 9/42; E06B 9/323; E06B 9/266; A47H 1/12; A47H 1/13; A47H 1/08; A47H 1/122; A47H 2001/003

See application file for complete search history.

(56) References Cited

U.S. PATENT DOCUMENTS 7,549,615 B2 * 6/2009 Shevick ..... E06B 9/323 248/200.1
10,597,938 B2 * 3/2020 Tan ..... A47H 1/12

(Continued)

FOREIGN PATENT DOCUMENTS

CN 211511377 U 9/2020
CN 112780171 A 5/2021

(Continued)

OTHER PUBLICATIONS

PCT International Search Report mailed Feb. 22, 2023, in corresponding PCT application PCT/CN2022/143766, 4 pages in Chinese.

*Primary Examiner* — Bradley Duckworth

(74) *Attorney, Agent, or Firm* — Juan Carlos A. Marquez; Marquez IP Law Office, PLLC

(57) ABSTRACT

The present invention provides an electronic cymbal which comprises an externally-mounted holing-free mounting mechanism for a curtain, comprising a cross beam exposed out of a window frame, a first mounting assembly and a second mounting assembly; the first mounting assembly and the second mounting assembly are supported in the window frame in cooperation with the cross beam, and both the first mounting assembly and the second mounting assembly are in slide cooperation with the cross beam. The length of the cross beam is greater than a width of the window frame, the curtain assembled on the cross beam can fully cover the entire window frame without light leakage. In addition, the first mounting assembly and the second mounting assembly are arbitrarily slidable on the cross beam, and thus, it is applicable to the window frames of multiple widths.

6 Claims, 7 Drawing Sheets

(56) References Cited

U.S. PATENT DOCUMENTS

| | | | | |
|---|---|---|---|---|
| 11,246,444 | B2 * | 2/2022 | Tan | E06B 9/40 |
| 11,326,394 | B2 * | 5/2022 | Tan | E06B 9/50 |
| 2007/0084568 | A1 | 4/2007 | Nien | |
| 2021/0137295 | A1 * | 5/2021 | Tan | A47H 1/08 |
| 2022/0186557 | A1 * | 6/2022 | Cugier | E06B 9/50 |
| 2024/0206663 | A1 * | 6/2024 | Tan | A47H 1/12 |

FOREIGN PATENT DOCUMENTS

| | | | |
|---|---|---|---|
| CN | 213359950 | U | 6/2021 |
| CN | 213962888 | U | 8/2021 |
| JP | 3232395 | U | 6/2021 |
| JP | 3239848 | U | 11/2022 |

* cited by examiner

EXTERNALLY-MOUNTED HOLING-FREE MOUNTING MECHANISM FOR CURTAIN

This application is based upon and claims priority to Chinese Patent Application No. 202221795002.0, filed on Jul. 10, 2022, the entire contents of which are incorporated herein by reference.

TECHNICAL FIELD

The present invention relates to the technical field of curtain accessories and in particular to an externally-mounted holing-free mounting mechanism for a curtain.

BACKGROUND

The existing holing-free mounting curtain is structured in such a way that at least one end of a mounting cross beam is connected with a holing-free mounting assembly and then the holing-free mounting curtain is supported in a window frame. This mounting structure eliminates the need for holing mounting and will not damage a wall surface. However, the curtain supported in the window frame may leak light. As shown in FIG. 1, since the holing-free mounting assembly connected at the end of the cross beam is supported in the window frame through a telescopic structure, the end of the cross beam cannot be fully attached to the window frame. In this case, a gap between an edge of the curtain body connected to the cross beam and an edge of the window frame may be formed, leading to incomplete sun-shading. That is, the larger the length that the holing-free mounting assembly protrudes out is, the larger the light-leaking gap is. Therefore, there is a problem of poor sun-shading. effect. At present, it is urgent to find a way to achieve the purpose of holing-free mounting and good sun-shading.

SUMMARY

For the above situations in the prior arts, in order to address the above technical problems, the present invention aims to provide an externally-mounted holing-free mounting mechanism for a curtain, which can achieve holing-free mounting and realize complete sun-shading for full attachment to a window frame.

In order to address the above technical problem, the present invention adopts the following technical solution: provided is an externally-mounted holing-free mounting mechanism for a curtain, comprising a cross beam exposed out of a window frame, a first mounting assembly and a second mounting assembly, where the first mounting assembly and the second mounting assembly are supported in the window frame in cooperation with the cross beam, and both the first mounting assembly and the second mounting assembly are in slide cooperation with the cross beam.

Furthermore, the first mounting assembly and the second mounting assembly both are provided with a locking piece for locking up the first mounting assembly and the second mounting assembly onto the cross beam. At least one of the first mounting assembly and the second mounting assembly is provided with an adjustment assembly for holding the first mounting assembly and the second mounting assembly in the window frame.

Furthermore, the first mounting assembly comprises a first slide seat and a first holding block, the first holding block is integrally connected with the first slide seat, and the first slide seat is in slide connection with the cross beam; the second mounting assembly comprises a second slide seat and a second holding block, the second slide seat is in slide connection with the cross beam, a mounting cabin is disposed on the second slide seat, and the second holding block is in movable cooperation with the mounting cabin through the adjustment assembly.

Furthermore, the cross beam is provided with a slide track which penetrate through both ends of the cross beam along a length of the cross beam, the first slide seat and the second slide seat opposed to each other are slidably connected to the slide track, and the locking pieces are connected to the first slide seat and the second slide seat respectively to lock the first slide seat and the second slide seat onto the slide track.

Furthermore, the adjustment assembly is mounted inside the mounting cabin. The adjustment assembly comprises a drive piece, a linkage piece, a locking block, a first elastic piece, and a second elastic piece. The second holding block is provided with a central shaft penetrating through the mounting cabin. The first elastic piece, the linkage piece, the second elastic piece are sequentially sleeved on the central shaft. The first elastic piece is close to the second holding block. The drive piece and the linkage piece are vertically crossed and linked cooperatively. At least one end of the drive piece is in communication with outside of the mounting cabin. The locking block is in thread-sleeving cooperation with the linkage piece. An end of the central shaft is connected with a screw and a washer, and in a natural state, the washer and an outer end surface of the mounting cabin perform blocking and limitation.

Furthermore, the drive piece is a worm rod, the linkage piece comprises a worm gear portion and a screw rod portion, the worm rod is in vertical engagement transmission with the worm gear portion, and the worm gear portion is in engagement transmission with the screw rod portion through an end surface gear ring. The locking block is thread-sleeved on the screw rod portion. The locking block crawls along the threads of the screw rod portion along with the rotation of the screw rod portion, and a through hole for exposing the ends of the worm rod is opened in the mounting cabin.

Furthermore, a limiting portion is disposed inside the mounting cabin, and an annular stepped surface abutted against the limiting portion is disposed on the screw rod portion. An end of the first elastic piece is abutted against an end of the screw rod portion away from the annular stepped surface, and the other end of the first elastic piece is abutted against the second holding block. Naturally, the first elastic piece is in a compressed state, an end of the first elastic piece squeezes the screw rod portion, and the limiting portion axially blocks the screw rod portion. The other end of the first elastic piece squeezes the second holding block, the second holding block partially protrudes out of the mounting cabin, and the washer at the end of the central shaft and the outer end surface of the mounting cabin perform blocking and limitation.

Furthermore, an end of the second elastic piece is abutted against an end of the worm gear portion away from the screw rod portion, and the other end of the second elastic piece is abutted against an inner end surface of the mounting cabin. Naturally, the second elastic piece is in a compressed state so as to squeeze the worm gear portion to be engaged with the screw rod portion.

Furthermore, a cavity penetrating through both ends of the cross beam is disposed inside the cross beam, and both ends of the cavity are used for inserting connection pieces.

Compared with the prior arts, the present invention has the following advantages: according to the present invention, the first mounting assembly and the second mounting assembly are slidably mounted on the cross beam; during assembling process, the cross beam is externally mounted on the window frame, and then the first mounting assembly and the second mounting assembly are slid to respectively abut against both inner sides of the window frame to achieve holing-free mounting. Because the cross beam is externally mounted, i.e. the length of the cross beam is greater than a width of the window frame, the curtain assembled on the cross beam can fully cover the entire window frame without light leakage. In addition, the first mounting assembly and the second mounting assembly are arbitrarily slidable on the cross beam, and thus, it is applicable to the window frames of multiple widths.

BRIEF DESCRIPTION OF THE DRAWINGS

In order to describe the embodiments of the present invention or the technical solution of the prior art more clearly, brief descriptions will be made below to the accompanying drawings involved in descriptions of the embodiments or the prior art. Obviously, the accompanying drawings are merely illustrative, and other drawings may also be obtained by those skilled in the art based on these drawings without paying creative work.

The structures, scales, sizes and the like depicted in the specification are only used by those skilled in the art to know and read the contents disclosed by the specification rather than to limit the embodiments of the present disclosure. Therefore, the structures, scales, sizes and the like do not have technically substantive meanings. Any modification, changes or adjustment to the structures, the scales and sizes shall all fall within the scope of protection covered by the technical contents disclosed by the present invention without affecting the effects and the purposes achieved by the present invention.

Figure 1:
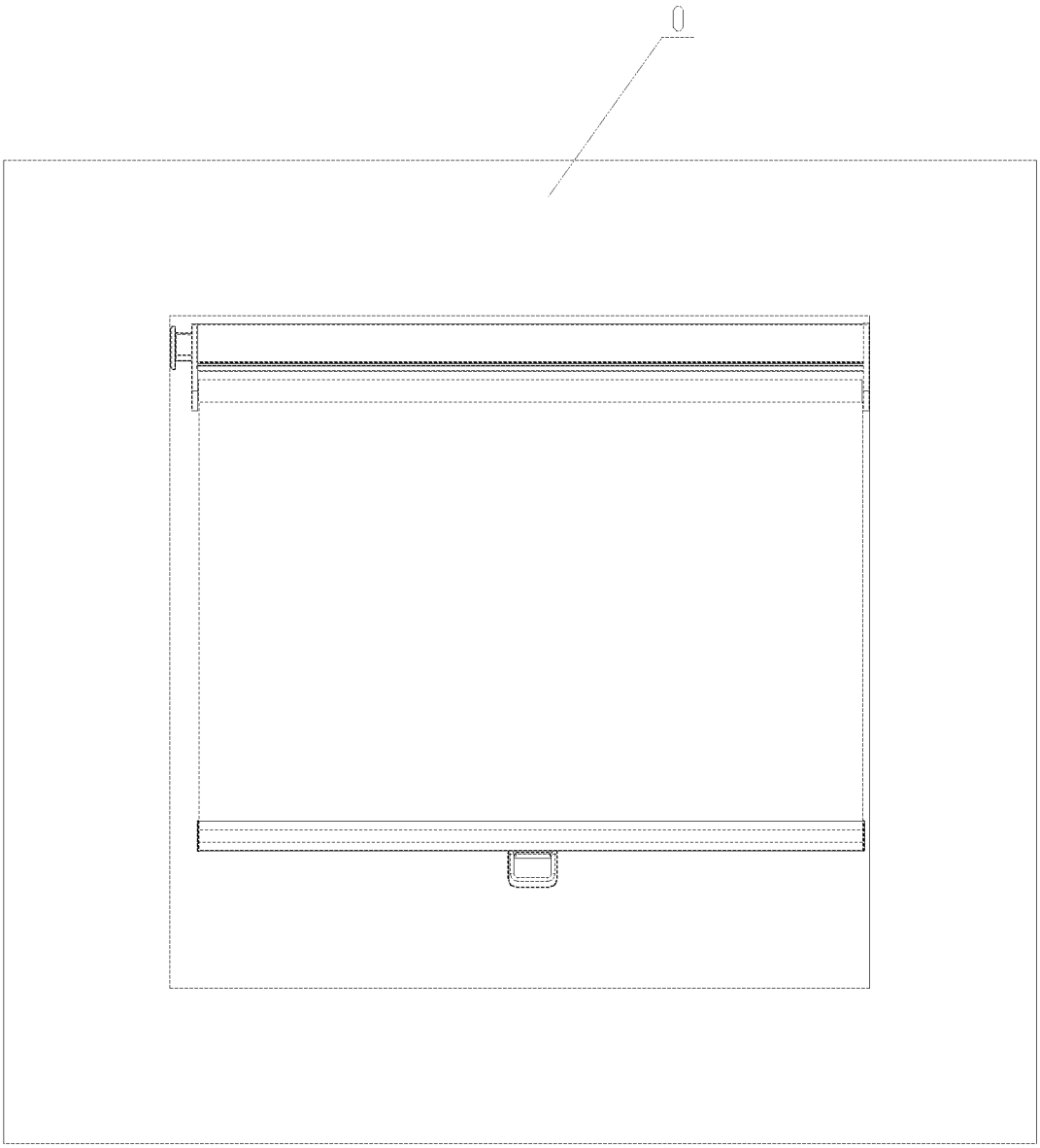
FIG. 1 is a schematic diagram of holing-free mounting of an internally-mounted curtain in the prior art.
Figure 2:
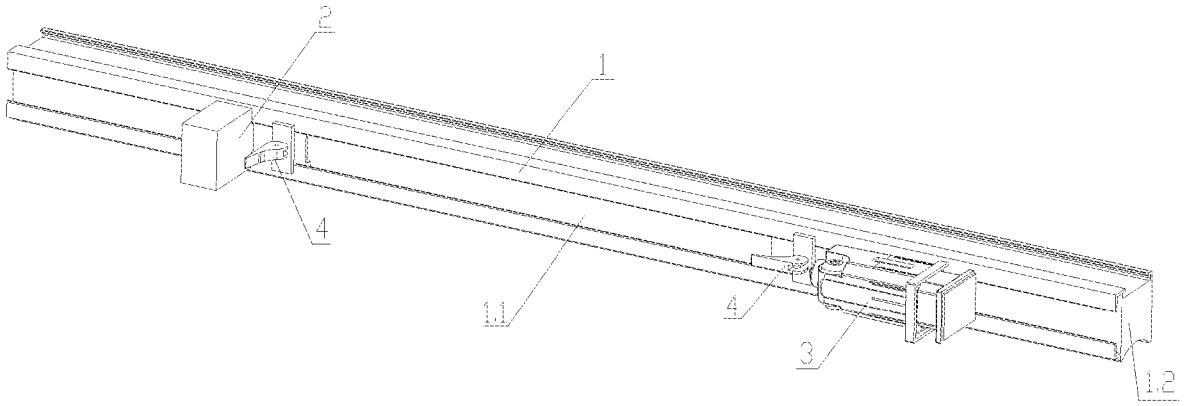
FIG. 2 is a structural schematic diagram of the present invention.

Numerals of the drawings are described below: 0 window frame, 1 cross beam, 1.1 slide track, 1.2 cavity, 2 first mounting assembly, 2.1 first slide seat, 2.2 first holding block, 3 second mounting assembly, 3.1 second slide seat, 3.2 second holding block, 3.2.1 central shaft, 3.3 mounting cabin, 3.3.1 through hole, 3.3.2 limiting portion, 4 locking piece, 5 adjustment assembly, 5.1 drive piece, 5.2 linkage piece, 5.2.1 worm gear portion, 5.2.2 screw rod portion, 5.2.2.1 annular stepped surface, 5.3 locking block, 5.4 first elastic piece, 5.5 second elastic piece, 6 screw, 7 washer.

DETAILED DESCRIPTIONS OF EMBODIMENTS

The present invention will be further described below in combination with the specific embodiments.

In the descriptions of the present invention, it is understood that orientation or positional relationship indicated by the terms such as "central", "longitudinal", "transverse", "length", "width", "thickness", "upper," "lower", "front", "rear", "left", "right", "vertical", "horizontal", "top", "bottom", "inside", "outside", "clockwise", "counterclockwise", "axial", "radial", and "circumferential" is used only for ease of descriptions and simplification of descriptions and does not indicate or imply that the indicated devices or elements must have a particular orientation, or be constructed or operated in a particular orientation. Therefore, such terms shall not be understood as limiting of the present invention.

Further, the terms "first" and "second" are used for descriptions only and shall not be understood as indicating or implying relative importance or implicitly indicating the number of the indicated features. As a result, the features defined by "first" and "second" may explicitly or implicitly include at least one feature. In the descriptions of the present invention, the meaning of "several" refers to at least two, for example, two or three or the like, unless otherwise clearly stated.

In the present invention, unless otherwise clearly stated or defined, the terms "mount", "connect", "couple", and "fix" and the like shall be understood in a broad sense, for example, may be fixed connection, or detachable connection, or formed into one piece; or may be mechanical connection, or electrical connection; or direct connection or indirect connection through an intermediate medium, or may be internal communication between two elements or mutual interaction of two elements, unless otherwise stated. Those skilled in the art may understand the specific meanings of the above terms in the present invention according to actual situations.

In the present invention, unless otherwise clearly stated or defined, the first feature being "on" or "below" the second feature refers to that the first feature and the second feature are in direct contact, or the first feature and the second feature are in indirect contact through an intermediate medium. Furthermore, the first feature being "above" or "on" the second feature refers to that the first feature is exactly above or obliquely above the second feature, or only refers to that the first feature has a higher horizontal height than the second feature. The first feature being "under" or "below" the second feature refers to that the first feature is exactly under or obliquely below the second feature, or only refers to that the first feature has a smaller horizontal height than the second feature.

As shown in FIGS. 2 to 10, the present invention provides an externally-mounted holing-free mounting mechanism for a curtain, including a cross beam 1 exposed out of a window frame 0, a first mounting assembly 2 and a second mounting assembly 3, where the first mounting assembly 2 and the second mounting assembly 3 are supported in the window frame 0 in cooperation with the cross beam 1, and both the first mounting assembly 2 and the second mounting assembly 3 are in slide cooperation with the cross beam 1. With the slide cooperation structure, a distance between the first mounting assembly 2 and the second mounting assembly 3 can be easily adjusted to adapt to the window frames 0 of different widths. The width of the window frame 0 refers to a distance between inner side surfaces of the window frame 0. The first mounting assembly 2 and the second mounting assembly 3 both are provided with a locking piece 4 for locking up the first mounting assembly 2 and the second mounting assembly 3 onto the cross beam 1. When a mounting distance is determined, the first mounting assembly 2 and the second mounting assembly 3 can be locked onto the cross beam 1 by the locking pieces 4, thus avoiding the influence of the free slide of the first mounting assembly 2 and the second mounting assembly 3 on mounting. At least one of the first mounting assembly 2 and the second mounting assembly 3 is provided with an adjustment assembly 5 for holding the first mounting assembly 2 and the second mounting assembly 3 in the window frame 0.

Figure 10:
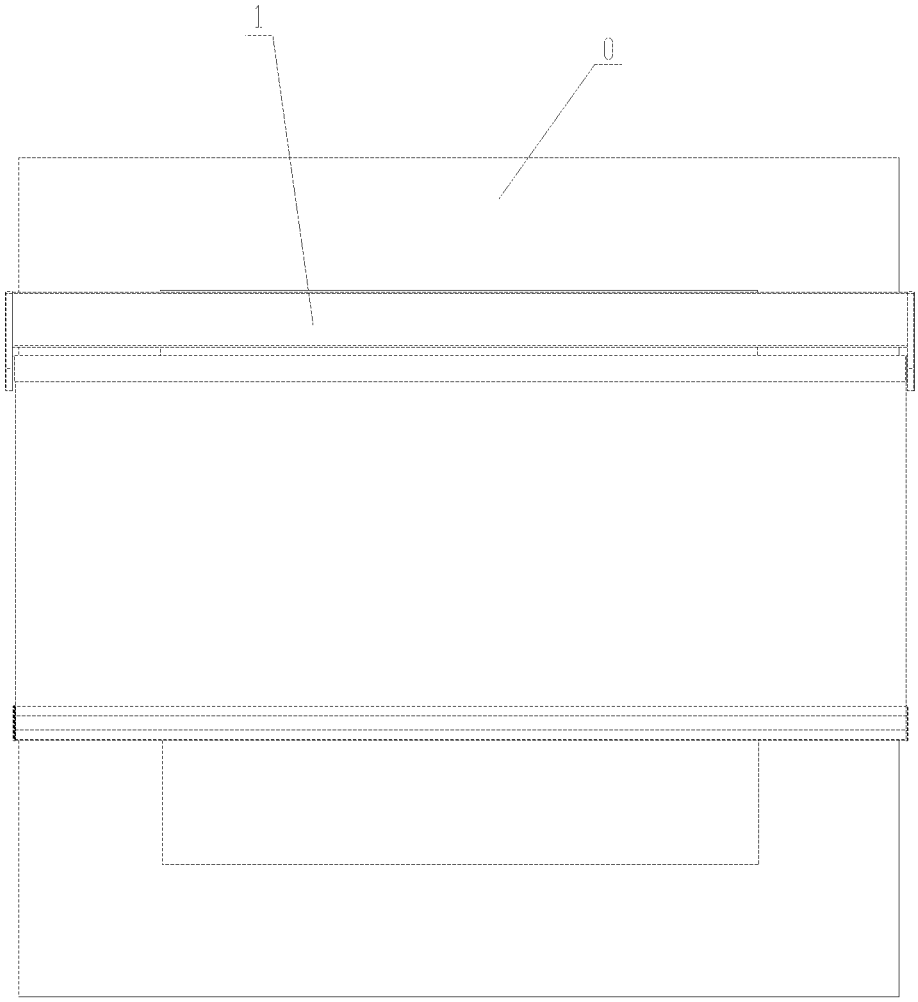
FIG. 10 is a structural schematic diagram of a window frame, a curtain body and the present invention assembled together.

According to the present invention, the first mounting assembly 2 and the second mounting assembly 3 are slidably mounted on the cross beam 1; during assembling process, the cross beam 1 is externally mounted on the window frame 0, and then the first mounting assembly 2 and the second mounting assembly 3 are slid to respectively abut against both inner sides of the window frame 0, and then locked to the cross beam 1 by use of the locking pieces 4 respectively, so as to achieve mounting. Next, further holding is performed using the adjustment assembly 5 to make the holing-free mounting firmer. Because the cross beam 1 is externally mounted, i.e. the length of the cross beam 1 is greater than a width of the window frame, a curtain assembled on the cross beam 1 can fully cover the entire window frame without light leakage. As shown in FIG. 10, in addition, the first mounting assembly 2 and the second mounting assembly 3 are arbitrarily slidable on the cross beam 1, and thus, it is applicable to the window frames 0 of multiple widths.

Figure 3:
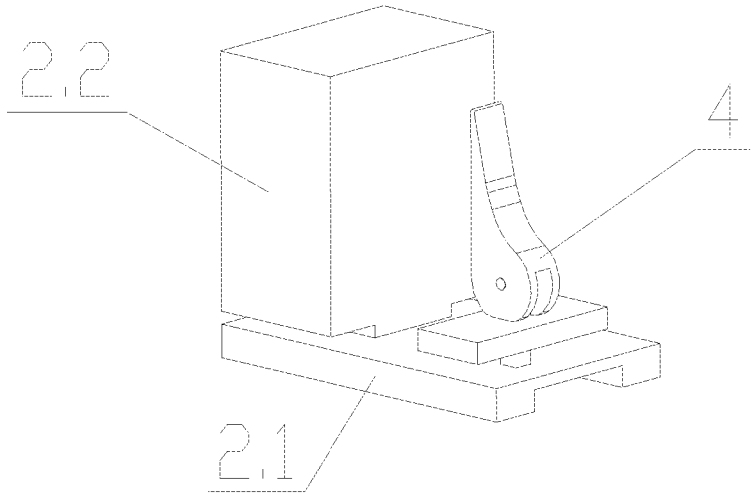
FIG. 3 is a structural schematic diagram of a first mounting assembly according to the present invention.
Figure 4:
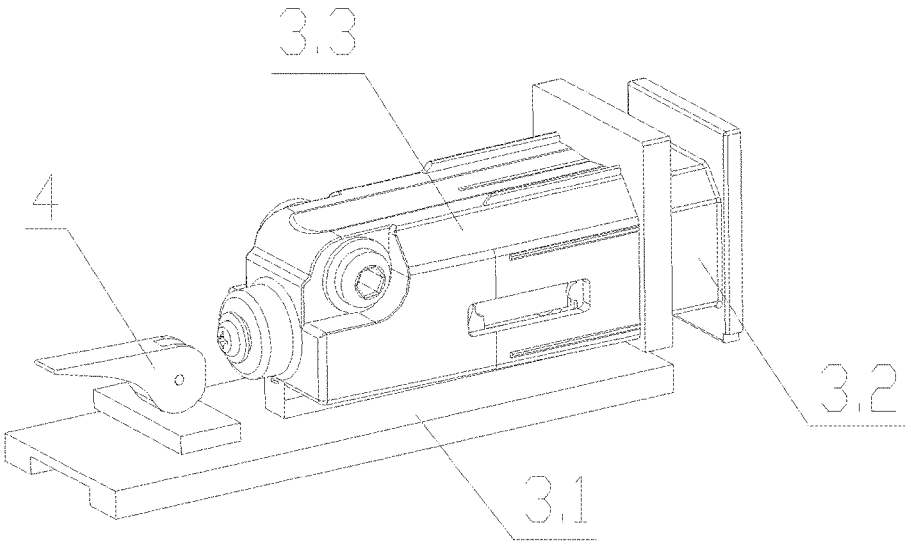
FIG. 4 is a structural schematic diagram of a second mounting assembly according to the present invention.

As shown in FIG. 3, the first mounting assembly 2 comprises a first slide seat 2.1 and a first holding block 2.2, the first holding block 2.2 is integrally connected with the first slide seat 2.1, and the first slide seat 2.1 is in slide connection with the cross beam 1; as shown in FIG. 4 the second mounting assembly 3 comprises a second slide seat 3.1 and a second holding block 3.2, the second slide seat 3.1 is in slide connection with the cross beam 1, a mounting cabin 3.3 is disposed on the second slide seat 3.1, and the second holding block 3.2 is in movable cooperation with the mounting cabin 3.3 through the adjustment assembly 5.

The cross beam 1 is provided with a slide track 1.1 which penetrates through both ends of the cross beam 1 along a length of the cross beam 1. The first slide seat 2.1 and the second slide seat 3.1 opposed to each other are slidably connected to the slide track 1.1. The locking pieces 4 are connected to the first slide seat 2.1 and the second slide seat 3.1 respectively to lock the first slide seat 2.1 and the second slide seat 3.1 onto the slide track 1.1. When the locking pieces 4 are unlocked, the first slide seat 2.1 and the second slide seat 3.1 may be slidable arbitrarily on the slide track 1.1. When the locking pieces 4 are locked, the first slide seat 2.1 and the second slide seat 3.1 may be fixed on the slide track 1.1.

Figure 5:
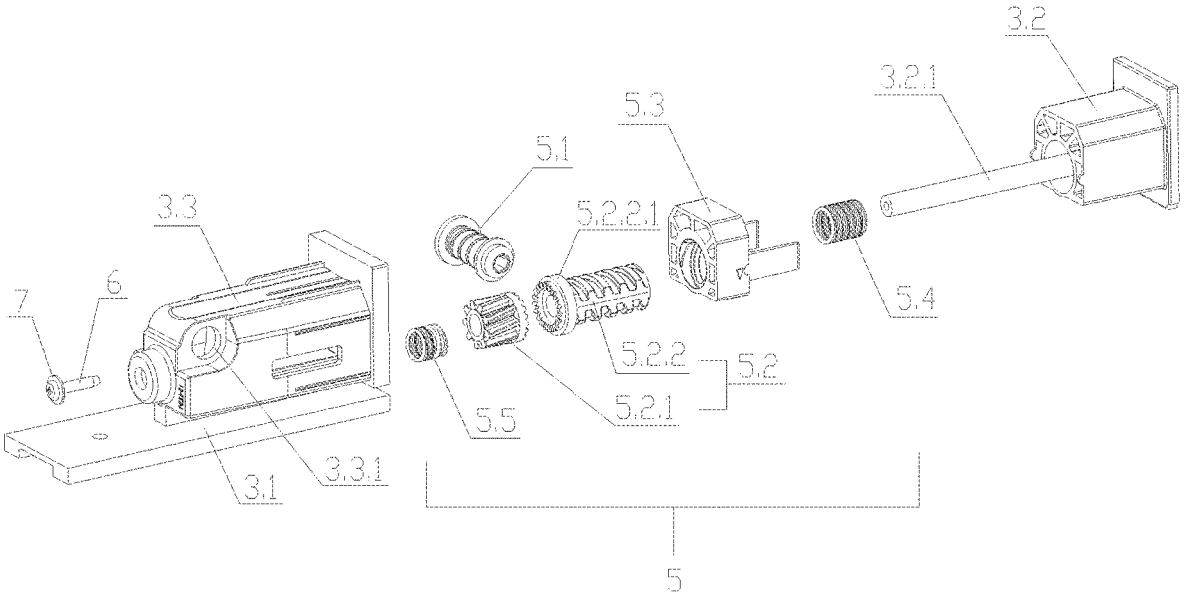
FIG. 5 is an exploded view of a second mounting assembly and an adjustment piece according to the present invention.
Figure 6:
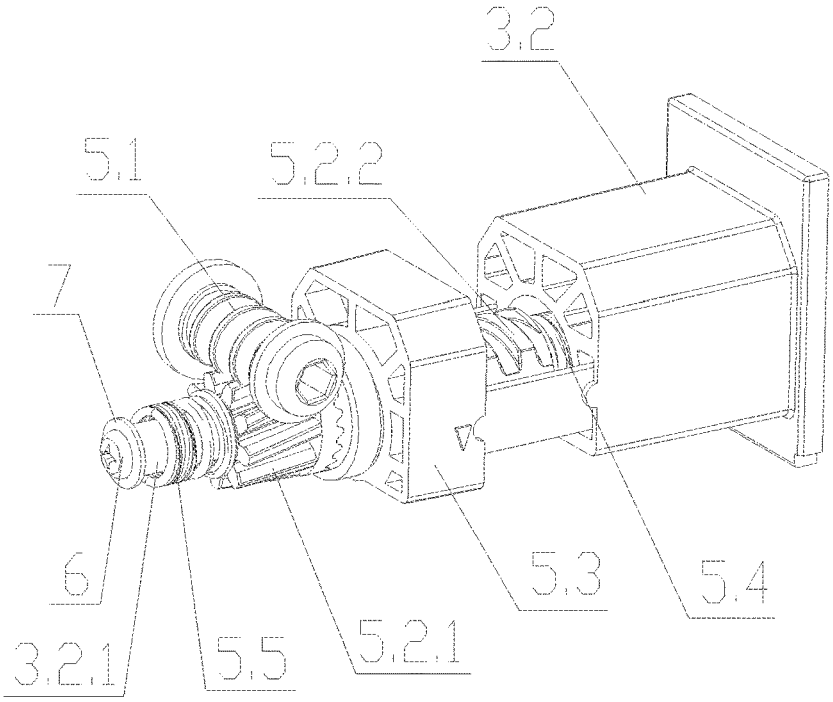
FIG. 6 is a structural schematic diagram of assembling of a second holding block and an adjustment assembly according to the present invention.

As shown in FIGS. 5 and 6, the adjustment assembly 5 is mounted inside the mounting cabin 3.3. The adjustment assembly 5 comprises a drive piece 5.1, a linkage piece 5.2, a locking block 5.3, a first elastic piece 5.4, and a second elastic piece 5.5. The second holding block 3.2 is provided with a central shaft 3.2.1 penetrating through the mounting cabin 3.3. The first elastic piece 5.4, the linkage piece 5.2, the second elastic piece 5.5 are sequentially sleeved on the central shaft 3.2.1. The first elastic piece 5.4 is close to the second holding block 3.2. The drive piece 5.1 and the linkage piece 5.2 are vertically crossed and linked cooperatively. At least one end of the drive piece 5.1 is in communication with outside of the mounting cabin 3.3 such that the drive piece 5.1 can be rotated by external tool. The locking block 5.3 is in thread-sleeving cooperation with the linkage piece 5.2. An end of the central shaft 3.2.1 is connected with a screw 6 and a washer 7 and in a natural state, the washer 7 and an outer end surface of the mounting cabin 3.3 perform blocking and limitation.

The drive piece 5.1 is a worm rod which is transversely disposed in the mounting cabin 3.3 and capable of rotating relative to the mounting cabin 3.3. The linkage piece 5.2 comprises a worm gear portion 5.2.1 and a screw rod portion 5.2.2. The worm rod is in vertical engagement transmission with the worm gear portion 5.2.1, that is, the worm gear portion 5.2.1 is penetrated onto the central shaft 3.2.1 and disposed along a length of the mounting cabin 3.3, and the worm rod is disposed along a width of the mounting cabin 3.3. With the structure in which the worm gear portion 5.2.1 and the worm rod are vertically crossed and linked, on one hand, stable operation and low noise can be achieved, and on the other hand, self-locking can be achieved to prevent reverse rotation, realizing safety and reliability. The worm gear portion 5.2.1 is in engagement transmission with the screw rod portion 5.2.2 through an end surface gear ring, that is, the worm rod drives the worm gear portion 5.2.1 and the worm gear portion 5.2.1 drives the screw rod portion 5.2.2 to coaxially rotate by gear ring engagement. The worm gear portion 5.2.1 and the screw rod portion 5.2.2 are disposed in a split manner such that the worm gear portion 5.2.1 and the screw rod portion 5.2.2 can be engaged for transmission and disengaged by tooth skip so as to avoid damage to the parts due to excess rotation. The locking block 5.3 is thread-sleeved on the screw rod portion 5.2.2. The locking block 5.3 crawls along the threads of the screw rod portion 5.2.2 along with the rotation of the screw rod portion 5.2.2, so as to hold or separate from the second holding block 3.2. A through hole 3.3.1 for exposing the ends of the worm rod is opened in the mounting cabin 3.3 to help an external tool to drive the worm rod to rotate.

Figure 7:
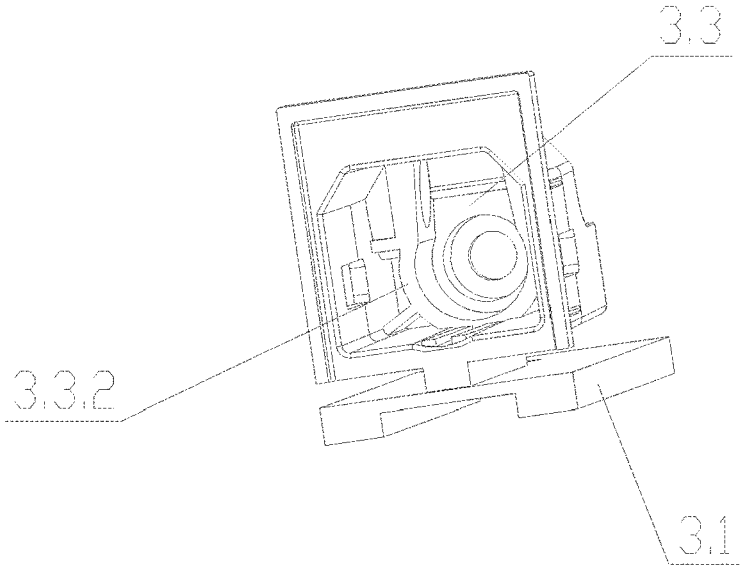
FIG. 7 is a structural schematic diagram illustrating a mounting cabin according to the present invention.

As shown in FIG. 7, a limiting portion 3.3.2 is disposed inside the mounting cabin 3.3. As shown in FIG. 5, an annular stepped surface 5.2.2.1 abutted against the limiting portion 3.3.2 is disposed on the screw rod portion 5.2.2. An end of the first elastic piece 5.4 is abutted against an end of the screw rod portion 5.2.2 away from the annular stepped surface 5.2.2.1, and the other end of the first elastic piece 5.4 is abutted against the second holding block 3.2. Naturally, the first elastic piece 5.4 is in a compressed state, an end of the first elastic piece 5.4 squeezes the screw rod portion 5.2.2, and the limiting portion 3.3.2 axially blocks the screw rod portion 5.2.2. The other end of the first elastic piece 5.4 squeezes the second holding block 3.2, the second holding block 3.2 partially protrudes out of the mounting cabin 3.3, and the washer 7 at the end of the central shaft 3.2.1 and the outer end surface of the mounting cabin 3.3 perform blocking and limitation to limit the second holding block 3.2 from ejecting out of the mounting cabin 3.3. The second holding block 3.2 can be elastically movable in the mounting cabin 3.3, and the screw rod portion 5.2.2 is always axially limited and held by the limiting portion 3.3.2 and the first elastic piece 5.4.

An end of the second elastic piece 5.5 is abutted against an end of the worm gear portion 5.2.1 away from the screw rod portion 5.2.2, and the other end of the second elastic piece 5.5 is abutted against an inner end surface of the mounting cabin 3.3. Naturally, the second elastic piece 5.5 is in a compressed state so as to squeeze the worm gear portion 5.2.1 to be engaged with the screw rod portion 5.2.2. When an external tool drives the worm rod to rotate, the worm rod is linked with the worm gear portion 5.2.1 and the worm gear portion 5.2.1 is linked with the screw rod portion 5.2.2 under the squeeze of the second elastic piece 5.5. When the rotation force is greater than the elastic force, the worm gear portion 5.2.1 reversely squeezes the second elastic piece 5.5 to cause tooth skip and resets in time under the action of the elastic force to engage the screw rod portion 5.2.2. The occurrence of tooth skip indicates that the screw rod portion 5.2.2 already drives the locking block 5.3 to lock up the second holding block 3.2, such that the second holding block 3.2 is firmly abutted against the window frame 0. In this case, there is no need to continue rotating the worm rod to drive the worm gear portion 5.2.1 to rotate, so as to avoid damage to the parts due to excess rotation or separation of the cross beam 1 due to insufficient rotation.

A cavity 1.2 penetrating through both ends of the cross beam 1 is disposed inside the cross beam 1, and both ends of the cavity 1.2 are used for inserting connection pieces for assembling the curtain body.

Figure 8:
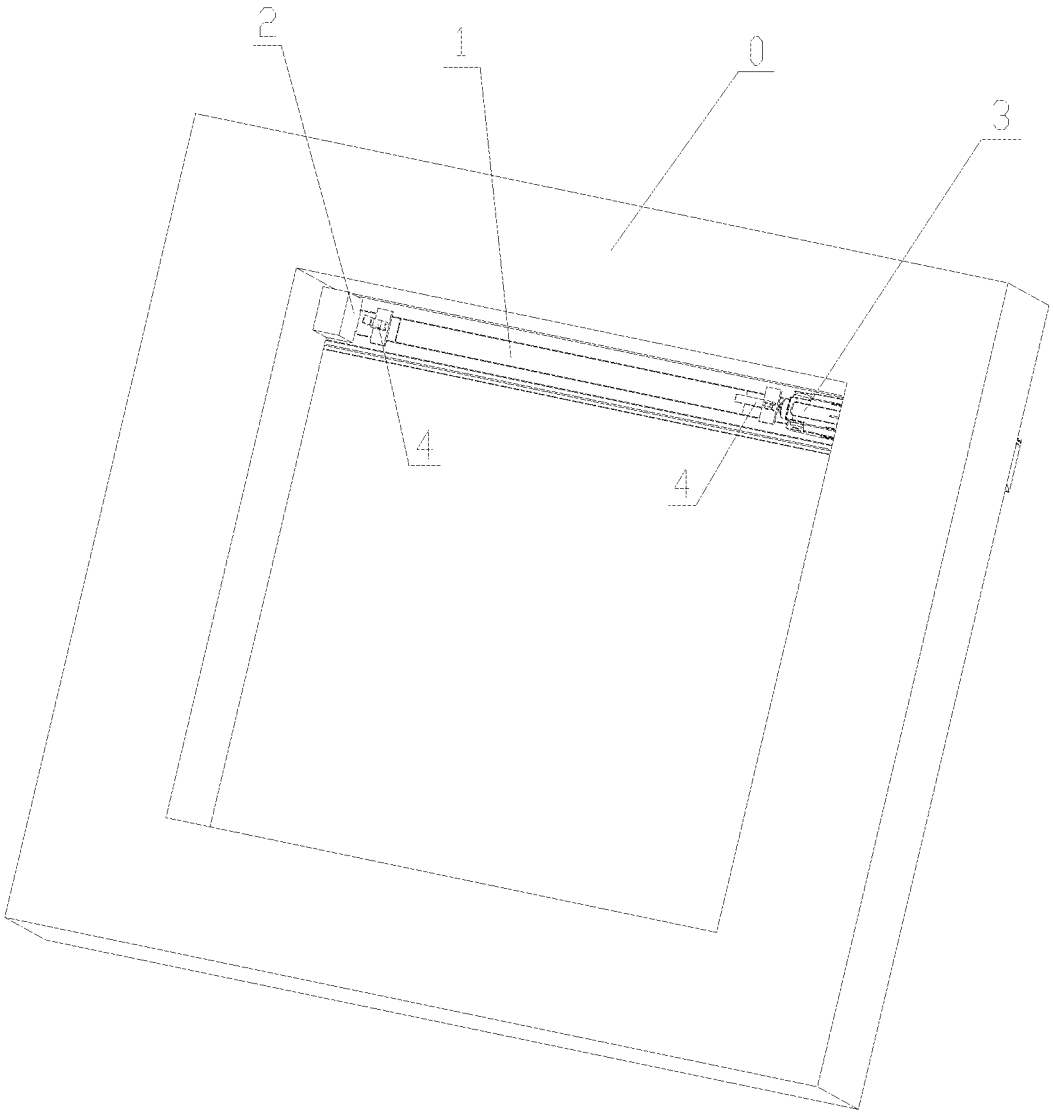
FIG. 8 is a structural schematic diagram illustrating a rear structure of a window frame and the present invention assembled together.
Figure 9:
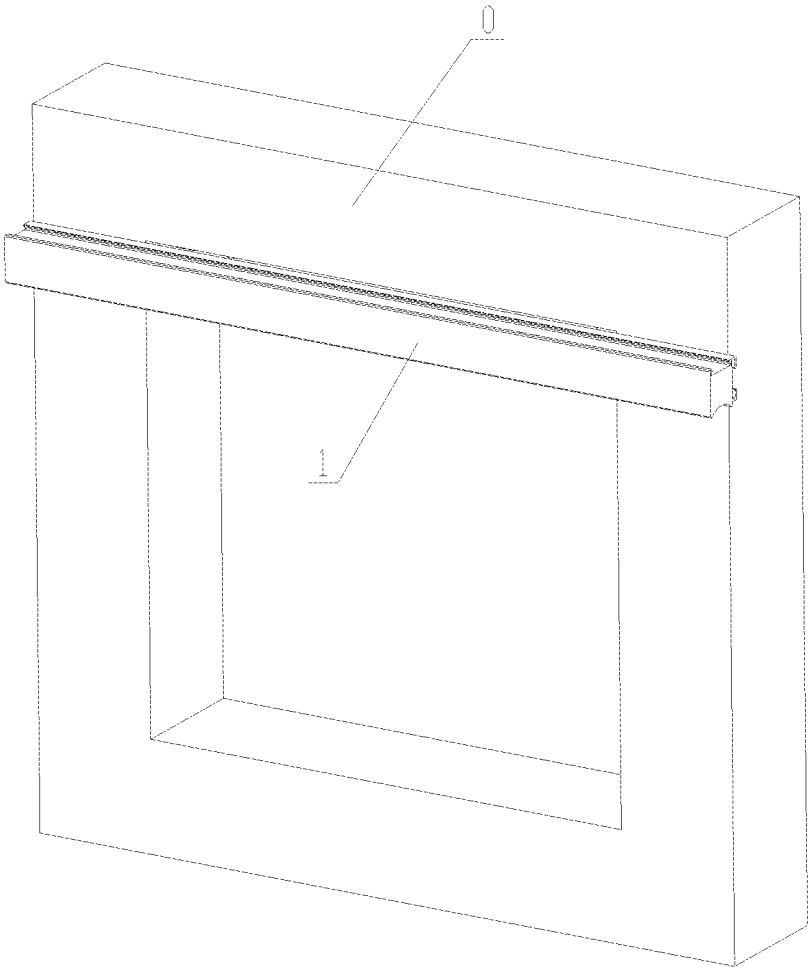
FIG. 9 is a schematic diagram illustrating a front structure of a window frame and the present invention assembled together.

During a mounting process, the locking pieces 4 are firstly unlocked, then the cross beam 1 is attached to an outer edge of the window frame 0 as shown in FIG. 9; next, the first slide seat 2.1 and the second slide seat 3.1 on the cross beam 1 are adjusted to enable the first holding block 2.2 and the second holding block 3.2 to be abutted against the inner side surfaces of the window frame 0 respectively for prepositioning as shown in FIG. 8; next, the first slide seat 2.1 and the slide seat 3.1 are locked up on the cross beam 1 by the locking pieces 4 to complete pre-mounting; and then an external tool is used to rotate the worm rod linked with the worm gear portion 5.2.1, the worm gear portion 5.2.1 is linked with the screw rod portion 5.2.2 and then the screw rod portion 5.2.2 is rotated to enable the locking block 5.3 to move along threads toward the second holding block 3.2 until the locking block 5.3 tightly holds and locks up the second holding block 3.2 to prevent elastic movement of the second holding block 3.2. In this way, the cross beam 1 is firmly mounted onto the window frame 0. At this time, if the worm rod is rotated further, tooth skip may occur between the worm gear portion 5.2.1 and the screw rod portion 5.2.2, that is, while the screw rod portion 5.2.2 keeps stationary, the worm gear portion 5.2.1 reversely squeezes the second elastic piece 5.5 by tooth skip to achieve protection effect. In this way, damage to the parts due to excess rotation can be avoided. In a case of dismounting, it is only required to reversely rotate the worm rod linked with the worm gear portion 5.2.1, and the worm gear portion 5.2.1 is linked with the screw rod portion 5.2.2 to enable the locking block 5.3 to reversely separate from the second holding block 3.2 along the screw rod portion 5.2.2, thereby achieving unlocking. Therefore, the dismounting is easy. It is not required to drill holes damaging a surface of the window frame and a mounting wall surface. Furthermore, since the cross beam 1 is externally mounted, the cross beam 1 can block the outer side of the entire window frame 0 as shown in FIGS. 9 and 10. Compared with the existing solution in which the cross beam is supported in the window frame, the externally-mounted holing-free mounting mechanism provided by the present invention can achieve better sun-shading. effect without any light leakage from the edge of the window frame.

In addition, it is noted that the first elastic piece 5.4 and the second elastic piece 5.5 in the present invention both are springs. Washers are disposed at the contact position of the first elastic piece 5.4 and the screw rod portion 5.2.2 and the contact position of the second elastic piece 5.5 and the worm gear portion 5.2.1 respectively to reduce friction and extend service life. The materials, reagents and experimental apparatuses involved in the embodiments of the present invention are commercially available products in curtain accessory field, unless otherwise stated.

Finally, it is to be noted that the above embodiments are merely used to describe the technical solution of the present invention rather than limit the present invention. Although detailed descriptions are made to the present invention by referring to the preceding embodiments, those skilled in the art should understand that the technical solutions recorded in the above embodiments may be modified or part of technical features thereof may be equivalently substituted. Such modifications or substitutions will not cause the essences of the corresponding technical solutions to depart from the spirits and scopes of the technical solutions of various embodiments of the present invention.

The invention claimed is:

1. An externally-mounted holing-free mounting mechanism for a curtain, comprising a cross beam exposed out of a window frame, a first mounting assembly and a second mounting assembly, wherein the first mounting assembly and the second mounting assembly are supported in the window frame in cooperation with the cross beam, and both the first mounting assembly and the second mounting assembly are in slide cooperation with the cross beam; the first mounting assembly and the second mounting assembly both are provided with a locking piece for locking up the first mounting assembly and the second mounting assembly onto the cross beam; at least one of the first mounting assembly and the second mounting assembly is provided with an adjustment assembly for holding the first mounting assembly and the second mounting assembly in the window frame;

the first mounting assembly comprises a first slide seat and a first holding block, the first holding block is integrally connected with the first slide seat, and the first slide seat is in slide connection with the cross beam, the second mounting assembly comprises a second slide seat and a second holding block, the second slide seat is in slide connection with the cross beam, a mounting cabin is disposed on the second slide seat, and the second holding block is in movable cooperation with the mounting cabin through the adjustment assembly; and the adjustment assembly is mounted inside the mounting cabin; the adjustment assembly comprises a drive piece, a linkage piece, a locking block, a first elastic piece, and a second elastic piece; the second holding block is provided with a central shaft penetrating through the mounting cabin; the first elastic piece, the linkage piece and the second elastic piece are sequentially sleeved on the central shaft; the first elastic piece is close to the second holding block; the drive piece and the linkage piece are vertically crossed and linked cooperatively; at least one end of the drive piece is in communication with outside of the mounting cabin; the locking block is in thread-sleeving cooperation with the linkage piece; and an end of the central shaft is connected with a screw and a washer.

2. The externally-mounted holing-free mounting mechanism for a curtain of claim 1, wherein the cross beam is provided with a slide track which penetrate through both ends of the cross beam along a length of the cross beam, the first slide seat and the second slide seat opposed to each other are slidably connected to the slide track, and the locking pieces are connected to the first slide seat and the second slide seat respectively to lock the first slide seat and the second slide seat onto the slide track.

3. The externally-mounted holing-free mounting mechanism for a curtain of claim 1, wherein the drive piece is a worm rod, and the linkage piece comprises a worm gear portion and a screw rod portion; the worm rod is in vertical engagement transmission with the worm gear portion, and the worm gear portion is in engagement transmission with the screw rod portion through an end surface gear ring; the locking block is thread-sleeved on the screw rod portion; the locking block crawls along the threads of the screw rod portion along with the rotation of the screw rod portion, and a through hole for exposing the ends of the worm rod is opened in the mounting cabin.

4. The externally-mounted holing-free mounting mechanism for a curtain of claim 3, wherein a limiting portion is disposed inside the mounting cabin, and an annular stepped surface abutted against the limiting portion is disposed on the screw rod portion; an end of the first elastic piece is abutted against an end of the screw rod portion away from the annular stepped surface, and the other end of the first elastic piece is abutted against the second holding block; the first elastic piece is in a compressed state and an end of the first elastic piece squeezes the screw rod portion, and the limiting portion axially blocks the screw rod portion, and the other end of the first elastic piece squeezes the second holding block, and the second holding block partially protrudes out of the mounting cabin, and the washer at the end of the central shaft blocks the outer end surface of the mounting cabin.

5. The externally-mounted holing-free mounting mechanism for a curtain of claim 4, wherein an end of the second elastic piece is abutted against an end of the worm gear portion away from the screw rod portion, and the other end of the second elastic piece is abutted against an inner end surface of the mounting cabin; the second elastic piece is in a compressed state so as to squeeze the worm gear portion to be engaged with the screw rod portion.

6. The externally-mounted holing-free mounting mechanism for a curtain of claim 1, wherein a cavity penetrating through both ends of the cross beam is disposed inside the cross beam, and both ends of the cavity are used for inserting first and second mounting assemblies.

* * * * *